US009986853B2

(12) United States Patent
Monegato et al.

(10) Patent No.: US 9,986,853 B2
(45) Date of Patent: Jun. 5, 2018

(54) MERCHANDISE DISPLAY SYSTEM

(71) Applicant: Samaritan Display, Schaumburg, IL (US)

(72) Inventors: Michael John Monegato, St. Charles, IL (US); James Anthony Wiemer, Fox Point, WI (US); Grzegorz T. Zwolenik, Mt. Prospect, IL (US)

(73) Assignee: AMD Industries, Inc., Cicero, IL (US)

( * ) Notice: Subject to any disclaimer, the term of this patent is extended or adjusted under 35 U.S.C. 154(b) by 0 days. days.

(21) Appl. No.: 15/643,944

(22) Filed: Jul. 7, 2017

(65) Prior Publication Data

US 2018/0008060 A1 Jan. 11, 2018

Related U.S. Application Data

(60) Provisional application No. 62/359,907, filed on Jul. 8, 2016.

(51) Int. Cl.

| | |
|---|---|
| ***E05D 7/081*** | (2006.01) |
| ***A47F 3/00*** | (2006.01) |
| ***E05D 15/48*** | (2006.01) |

(52) U.S. Cl.

CPC ..... *A47F 3/005* (2013.01); *E05D 7/081* (2013.01); *E05D 15/48* (2013.01); *E05D 2015/485* (2013.01)

(58) Field of Classification Search

CPC .. A47F 2003/008; A47F 3/043; A47F 3/0434; E05D 7/081; E05D 15/48; E05D 2015/485

See application file for complete search history.

(56) References Cited

U.S. PATENT DOCUMENTS

| | | | | |
|---|---|---|---|---|
| 2,669,499 | A | 2/1954 | Vanderplank | |
| 4,974,912 | A | 12/1990 | Rask | |
| 5,108,165 | A | 4/1992 | Rorke | |
| 7,322,661 | B1 | 1/2008 | Salvesen | |
| 8,381,443 | B2 * | 2/2013 | Smith | E05D 15/48 49/125 |
| 8,484,895 | B2 * | 7/2013 | Kuhnmuench | E05D 15/48 49/149 |
| 8,550,277 | B2 | 10/2013 | Gronholm | |
| 9,289,079 | B2 * | 3/2016 | Reichert | A47F 3/0434 |
| 9,637,970 | B1 * | 5/2017 | Rendon, Jr. | E06B 3/509 |
| 9,814,327 | B2 * | 11/2017 | Giulietti | A47F 3/0478 |
| 2002/0117946 | A1 | 8/2002 | Lombardo | |

(Continued)

*Primary Examiner* — Daniel J Rohrhoff

(74) *Attorney, Agent, or Firm* — McDermott Will & Emery LLP

(57) ABSTRACT

A modular merchandise display system is provided. The system comprises an enclosure, a first upper bracket and a first lower bracket forming a first pocket on a first side of the enclosure, and a second upper bracket and a second lower bracket forming a second pocket on a second side of the enclosure. A first security door is slidably and pivotally connected to the first upper and lower brackets. A second security door slidably and pivotally connected to the second upper and lower brackets. The security doors can be positioned exterior of the enclosure and then pivoted about the upper and lower brackets to be positioned substantially parallel to the front of the enclosure in a closed position. The security doors can then be secured to one another in the closed position.

20 Claims, 11 Drawing Sheets

(56) References Cited

U.S. PATENT DOCUMENTS

| | | | | |
|---|---|---|---|---|
| 2004/0046488 | A1 | 3/2004 | Hogan | |
| 2004/0100171 | A1 | 5/2004 | Brown | |
| 2004/0239216 | A1 | 12/2004 | Castillo | |
| 2007/0159037 | A1 | 7/2007 | Hoffman | |
| 2015/0008811 | A1 | 1/2015 | Ishii | |
| 2015/0300075 | A1 | 10/2015 | Lyons | |
| 2016/0309918 | A1* | 10/2016 | Giulietti | A47F 3/0478 |
| 2017/0071362 | A1 | 3/2017 | Marler | |
| 2017/0164763 | A1* | 6/2017 | Weiss | A47F 3/0434 |

* cited by examiner

MERCHANDISE DISPLAY SYSTEM

CROSS-REFERENCE TO RELATED APPLICATIONS

This application claims the benefit of U.S. Provisional Patent Application No. 62/359,907, filed Jul. 8, 2016, which is expressly incorporated herein by reference and made a part hereof.

FEDERALLY SPONSORED RESEARCH OR DEVELOPMENT

Not Applicable.

TECHNICAL FIELD

The present invention relates generally to a merchandise display system, and more specifically to a modular merchandise display system with locking security doors.

BACKGROUND

Merchandise display systems with or without refrigeration and having glass doors for easy viewing of the products inside are well known in the art. Traditionally, merchandise display systems are located inside a retail establishment, such as inside a grocery store or a gas station mini-mart. While such merchandise display systems according to the prior art provide a number of advantages, they nevertheless have certain limitations. For example, the display cases typically do not have locks or security features as off-hours security of the merchandise inside the display cases is typically provided by locking exterior doors of the building to prevent access to anything within the building. Further, typical merchandising display systems do not provide overhead protection from inclement weather or sun as they are typically inside a protected building. Also, typical merchandise display systems are of a fixed size. The present disclosure seeks to overcome certain of these limitations and other drawbacks of the prior art, and to provide new features not heretofore available. A full discussion of the features and advantages of the present disclosure is deferred to the following detailed description, which proceeds with reference to the accompanying drawings.

SUMMARY

According to one embodiment, the disclosed subject technology relates to a modular merchandise display system.

The disclosed technology further relates to a modular merchandise display system comprising: a first enclosure having a top wall, a bottom wall, a back wall connecting the top wall and the bottom wall, a first side wall connecting the top wall, bottom wall and back wall, and a second side wall connecting the top wall, bottom wall and back wall, the first enclosure having a first interior cavity between the first side wall, top wall, bottom wall, second side wall and back wall, the first enclosure further having at least one door at a front of the first enclosure closing the first interior cavity; a second enclosure having a top wall, a bottom wall, a back wall connecting the top wall and the bottom wall, a first side wall connecting the top wall, bottom wall and back wall, and a second side wall connecting the top wall, bottom wall and back wall, the second enclosure having a second interior cavity between the first side wall, top wall, bottom wall, second side wall and back wall, the second enclosure further having at least one door at a front of the second enclosure closing the second interior cavity; a frame supporting the first enclosure and the second enclosure, the frame having lateral supports and feet; a first upper bracket connected to the first side wall of the first enclosure adjacent a top of the first enclosure, the first upper bracket having a slot extending about a length of the first upper bracket; a first lower bracket connected to the first side wall of the first enclosure adjacent a bottom of the first enclosure, the first lower bracket having a slot extending about a length of the first lower bracket; a first security door for the first enclosure, the first security door being adjacent the first side wall of the first enclosure in an open position, the first security door having a first pin extending from a top thereof and through the slot in the first upper bracket, the first security door further having a second pin extending from a bottom thereof and through the slot in the first lower bracket, the first security door being slidingly moveable about the first side wall of the first enclosure to be positioned exterior of the first enclosure, the first security door further being pivotable about the first upper and lower brackets to be positioned substantially parallel to the front of the first enclosure in a closed position; a second upper bracket connected to the second side wall of the first enclosure adjacent a top of the first enclosure, the second upper bracket having a slot extending about a length of the second upper bracket; a second lower bracket connected to the second side wall of the first enclosure adjacent a bottom of the first enclosure, the second lower bracket having a slot extending about a length of the second lower bracket; a second security door for the first enclosure, the second security door being adjacent the second side wall of the first enclosure in an open position, the second security door having a first pin extending from a top thereof and through the slot in the second upper bracket, the second security door further having a second pin extending from a bottom thereof and through the slot in the second lower bracket, the second security door being slidingly moveable about the second side wall of the first enclosure to be positioned exterior of the first enclosure, the second security door further being pivotable about the second upper and lower brackets to be positioned substantially parallel to the front of the first enclosure in a closed position, and wherein the first security door is adapted to be secured to the second security door in the closed position; a third upper bracket connected to the first side wall of the second enclosure adjacent a top of the second enclosure, the third upper bracket having a slot extending about a length of the third upper bracket; a third lower bracket connected to the first side wall of the second enclosure adjacent a bottom of the second enclosure, the third lower bracket having a slot extending about a length of the third lower bracket; a third security door for the second enclosure, the third security door being adjacent the first side wall of the second enclosure in an open position, the third security door having a first pin extending from a top thereof and through the slot in the third upper bracket, the third security door further having a second pin extending from a bottom thereof and through the slot in the third lower bracket, the third security door being slidingly moveable about the first side wall of the second enclosure to be positioned exterior of the second enclosure, the third security door further being pivotable about the third upper and lower brackets to be positioned substantially parallel to the front of the second enclosure in a closed position; a fourth upper bracket connected to the second side wall of the second enclosure adjacent a top of the second enclosure, the fourth upper bracket having a slot extending about a length of the fourth upper bracket; a fourth lower bracket connected to the second side wall of the second enclosure adjacent a bottom of the second enclosure, the fourth lower bracket having a slot extending about a length of the fourth lower bracket; a fourth security door for the second enclosure, the fourth security door being adjacent the second side wall of the second enclosure in an open position, the fourth security door having a first pin extending from a top thereof and through the slot in the fourth upper bracket, the fourth security door further having a second pin extending from a bottom thereof and through the slot in the fourth lower bracket, the fourth security door being slidingly moveable about the second side wall of the second enclosure to be positioned exterior of the second enclosure, the fourth security door further being pivotable about the fourth upper and lower brackets to be positioned substantially parallel to the front of the second enclosure in a closed position, and wherein the fourth security door is adapted to be secured to the third security door in the closed position; and, a top panel over the first and second enclosure.

The disclosed technology further relates to a modular merchandise display system comprising: a first enclosure having a top wall, a bottom wall, a back wall connecting the top wall and the bottom wall, a first side wall connecting the top wall, bottom wall and back wall, and a second side wall connecting the top wall, bottom wall and back wall, the first enclosure having a first interior cavity between the first side wall, top wall, bottom wall, second side wall and back wall, the first enclosure further having at least one door at a front of the first enclosure closing the first interior cavity; a frame supporting the first enclosure; a first upper bracket connected to the first side wall of the first enclosure adjacent a top of the first enclosure, the first upper bracket having a slot extending about a length of the first upper bracket; a first lower bracket connected to the first side wall of the first enclosure adjacent a bottom of the first enclosure, the first lower bracket having a slot extending about a length of the first lower bracket; a first security door for the first enclosure, the first security door being adjacent the first side wall of the first enclosure in an open position, the first security door having a first pin extending from a top thereof and through the slot in the first upper bracket, the first security door further having a second pin extending from a bottom thereof and through the slot in the first lower bracket, wherein the first upper bracket and first lower bracket have flanges to form a pocket for the first security door, the first security door being slidingly moveable to be positioned exterior of the first enclosure, the first security door further being pivotable about the first upper and lower brackets to be positioned substantially parallel to the front of the first enclosure in a closed position; a second upper bracket connected to the second side wall of the first enclosure adjacent a top of the first enclosure, the second upper bracket having a slot extending about a length of the second upper bracket; a second lower bracket connected to the second side wall of the first enclosure adjacent a bottom of the first enclosure, the second lower bracket having a slot extending about a length of the second lower upper bracket; a second security door for the first enclosure, the second security door being adjacent the second side wall of the first enclosure in an open position, the second security door having a first pin extending from a top thereof and through the slot in the second upper bracket, the second security door further having a second pin extending from a bottom thereof and through the slot in the second lower bracket, wherein the second upper bracket and second lower bracket have flanges to form a pocket for the second security door, the second security door being slidingly moveable to be positioned exterior of the second enclosure, the second security door further being pivotable about the second upper and lower brackets to be positioned substantially parallel to the front of the second enclosure in a closed position, wherein the first security door is adapted to be secured to the second security door when the first and second security doors are in the closed positions; a first side panel connected adjacent the first side wall of the first enclosure, and a second side panel connected adjacent the second side wall of the first enclosure; and, a top panel over the first enclosure.

The disclosed technology further relates to a modular merchandise display system comprising: a plurality of enclosures, each of the plurality of enclosures having a top wall, a bottom wall, a back wall connecting the top wall and the bottom wall, a first side wall connecting the top wall, bottom wall and back wall, and a second side wall connecting the top wall, bottom wall and back wall, each of the plurality of enclosures having a first interior cavity between the first side wall, top wall, bottom wall, second side wall and back wall thereof, and each of the plurality of enclosures having a door at a front of the enclosure closing the interior cavity; a frame supporting the plurality of enclosures, the frame having lateral supports and transverse supports, and feet connected to the transverse supports; each of the plurality of enclosures having a first upper bracket connected to the first side wall of the respective enclosure adjacent a top of the enclosure, the first upper bracket having a slot extending about a length of the first upper bracket; each of the plurality of enclosures having a first lower bracket connected to the first side wall of the respective enclosure adjacent a bottom of the enclosure, the first lower bracket having a slot extending about a length of the first lower bracket; each of the plurality of enclosures having a first security door adjacent the first side wall of the respective enclosure in an open position, the first security door having a first pin extending from a top thereof and through the slot in the first upper bracket, the first security door further having a second pin extending from a bottom thereof and through the slot in the first lower bracket, wherein the first upper bracket and first lower bracket have flanges to form a pocket for the first security door, the first security door being slidingly moveable to be positioned exterior of the respective enclosure, the first security door further being pivotable about the first upper and lower brackets to be positioned substantially parallel to the front of the respective enclosure in a closed position; each of the plurality of enclosures having a second upper bracket connected to the second side wall of the respective enclosure adjacent a top of the enclosure, the second upper bracket having a slot extending about a length of the second upper bracket; each of the plurality of enclosures having a second lower bracket connected to the second side wall of the respective enclosure adjacent a bottom of the enclosure, the second lower bracket having a slot extending about a length of the second lower bracket; each of the plurality of enclosures having a second security door adjacent the second side wall of the respective enclosure in an open position, the second security door having a first pin extending from a top thereof and through the slot in the second upper bracket, the second security door further having a second pin extending from a bottom thereof and through the slot in the second lower bracket, wherein the second upper bracket and second lower bracket have flanges to form a pocket for the second security door, the second security door being slidingly moveable to be positioned exterior of the respective enclosure, the second security door further being pivotable about the second upper and lower brackets to be positioned substantially parallel to the front of the respective enclosure in a closed position, wherein each first security door is adapted to be secured to the respective second security door when the first and second security doors are in the closed positions; a first side panel connected adjacent the first side wall of one enclosure and the second side wall of an adjacent enclosure, and a second side panel connected adjacent the second side wall of another enclosure and the first sidewall of an adjacent enclosure; a top panel over the plurality of enclosures; and, a connector having one end connecting the top of the plurality of enclosures, and a second end supporting the top panel.

The disclosed technology further relates to a modular merchandise display system wherein the first upper bracket and first lower bracket have flanges to form a pocket for the first security door, wherein the second upper bracket and second lower bracket have flanges to form a pocket for the second security door, wherein the third upper bracket and third lower bracket have flanges to form a pocket for the third security door, and wherein the fourth upper bracket and fourth lower bracket have flanges to form a pocket for the fourth security door.

The disclosed technology further relates to a modular merchandise display system further comprising separate sliding members connected, respectively, to the bottom of the first security door, second security door, third security door and fourth security doors.

The disclosed technology further relates to a modular merchandise display system further comprising separate sliding members connected, respectively, to the top of the first security door, second security door, third security door and fourth security doors.

The disclosed technology further relates to a modular merchandise display system wherein the sliding members at the bottom of the security doors have a width greater than a width of the respective first security door, second security door, third security door and fourth security doors, to assist in sliding the first security door, second security door, third security door and fourth security doors from the open position to the closed position.

The disclosed technology further relates to a modular merchandise display system wherein the sliding members at the top of the security doors have a width greater than a width of the respective first security door, second security door, third security door and fourth security doors, to assist in sliding the first security door, second security door, third security door and fourth security doors from the open position to the closed position.

The disclosed technology further relates to a modular merchandise display system further comprising a bushing between the first upper bracket and a top of the first security door, a bushing between the second upper bracket and a top of the second security door, a bushing between the third upper bracket and a top of the third security door, and a bushing between the fourth upper bracket and a top of the fourth security door.

The disclosed technology further relates to a modular merchandise display system further comprising separate bushings around the first pins extending from the top of the first security door, second security door, third security door and fourth security door.

The disclosed technology further relates to a modular merchandise display system wherein the frame comprises a transverse supports connected to the lateral supports, wherein the enclosures are supported on the transverse supports, and wherein the feet are connected to the transverse supports.

The disclosed technology further relates to a modular merchandise display system further comprising a connector connected to the top of the first and second enclosures to secure the first and second enclosures together, the connector further supporting the top panel.

The disclosed technology further relates to a modular merchandise display system further comprising a first side panel connected to the first side wall of the first enclosure, and a second side panel connected to the second side wall of the second enclosure.

The disclosed technology further relates to a modular merchandise display system further comprising a support on the first and second side panels, respectively, for retaining a side graphic panel.

The disclosed technology further relates to a modular merchandise display system wherein the first side panel is connected to the first upper bracket and first lower bracket, and wherein the second side panel is connected to the second upper bracket and second lower bracket.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present invention, it will now be described by way of example only, not by way of limitation, with reference to the accompanying drawings in which.

DETAILED DESCRIPTION

Figure 1:
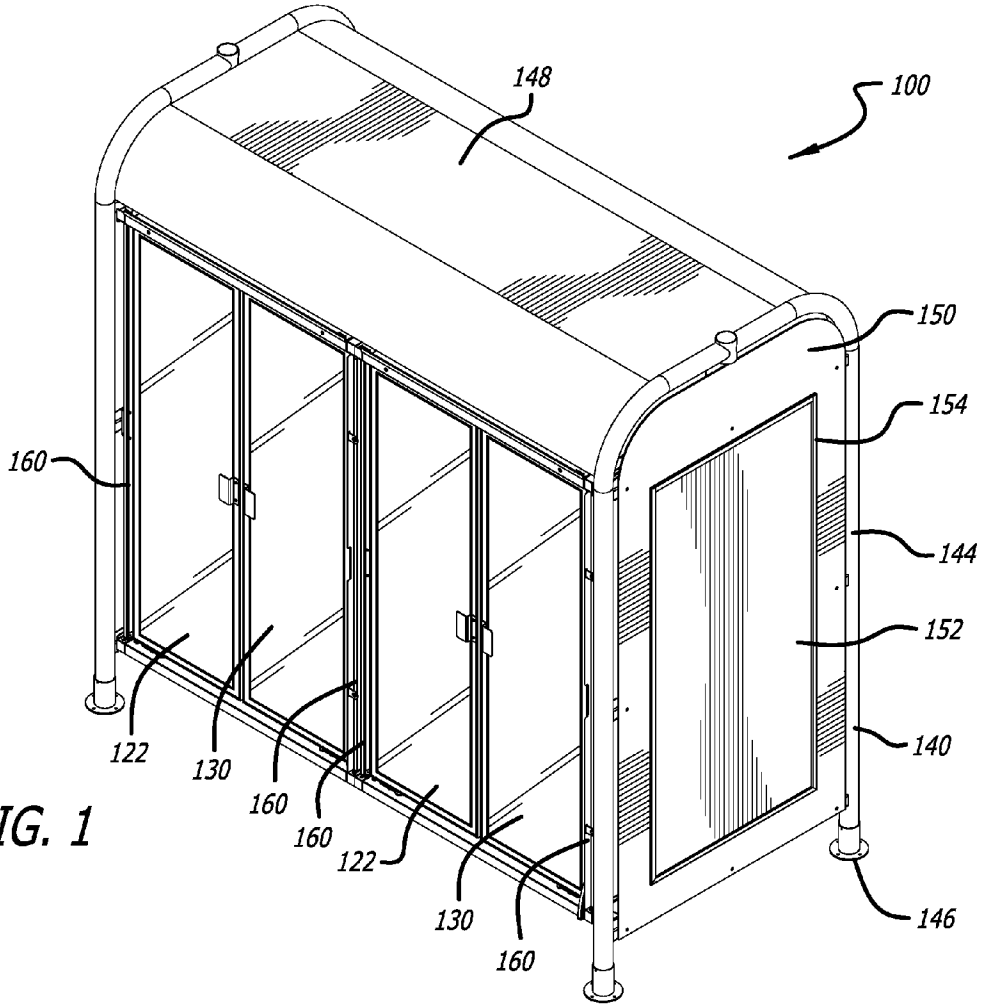
FIG. 1 is a perspective view of one embodiment of a merchandise display system, with the security doors in the open or storage position.

While the merchandise display system is susceptible of embodiments in many different forms, there is shown in the drawings and will herein be described in detail preferred embodiments with the understanding that the present disclosure is to be considered as an exemplification of the principles of the merchandise display system and is not intended to limit the broad aspects of the disclosure to the embodiments illustrated.

Referring now to the figures, and specifically to FIGS. 1-7, there is shown a modular merchandise display system 100 generally comprising a housing 110 having a first side wall 112*a*, a second side wall 112*b*, a bottom wall 114, a top wall 116 and a rear wall 118. The housing 110 may also be referred to as an enclosure 110 or cabinet 110. The housing 110 may be configured to support one or more shelves 120 for storing and/or displaying merchandise. For example, the merchandise display system 100 may provide drinks and food items for sale to customers, where the drinks and food items are stored and displayed on the shelves 120 for easy viewing and removal by the customer. Alternately, the housing 110 may be configured to support one or more shelves 120 for storing and/or displaying non-food items, such as, for example, automotive supplies. At least one display door 122, and preferably two display doors 122, are disposed at a front of the housing 110 and are configured to open to provide access to an interior cavity 124 of the merchandise display system 100. For example, the display doors 122 may be rotatably connected to the bottom and top walls 114, 116, connected by hinges to the side walls 112, slidably connected to the bottom and top walls 114, 116, or the like. The display doors 122 are preferably at least partially transparent (e.g., glass, plastic, plexiglass) to allow easy viewing of the products in the interior of the cavity 124 of the housing 110 when the display doors 122 are closed. The housing 110 and the display doors 122 may form an enclosure 130 that provides a sealed or substantially sealed environment for maintaining temperature control and/or keeping the interior free of dust or dirt. In one example, the enclosure 130 may be a refrigerated unit that provides storage and display of cold or frozen products. In an alternate embodiment, the enclosure 130 provides a non-refrigerated unit that provides storage and display of other types of products.

Figure 7:
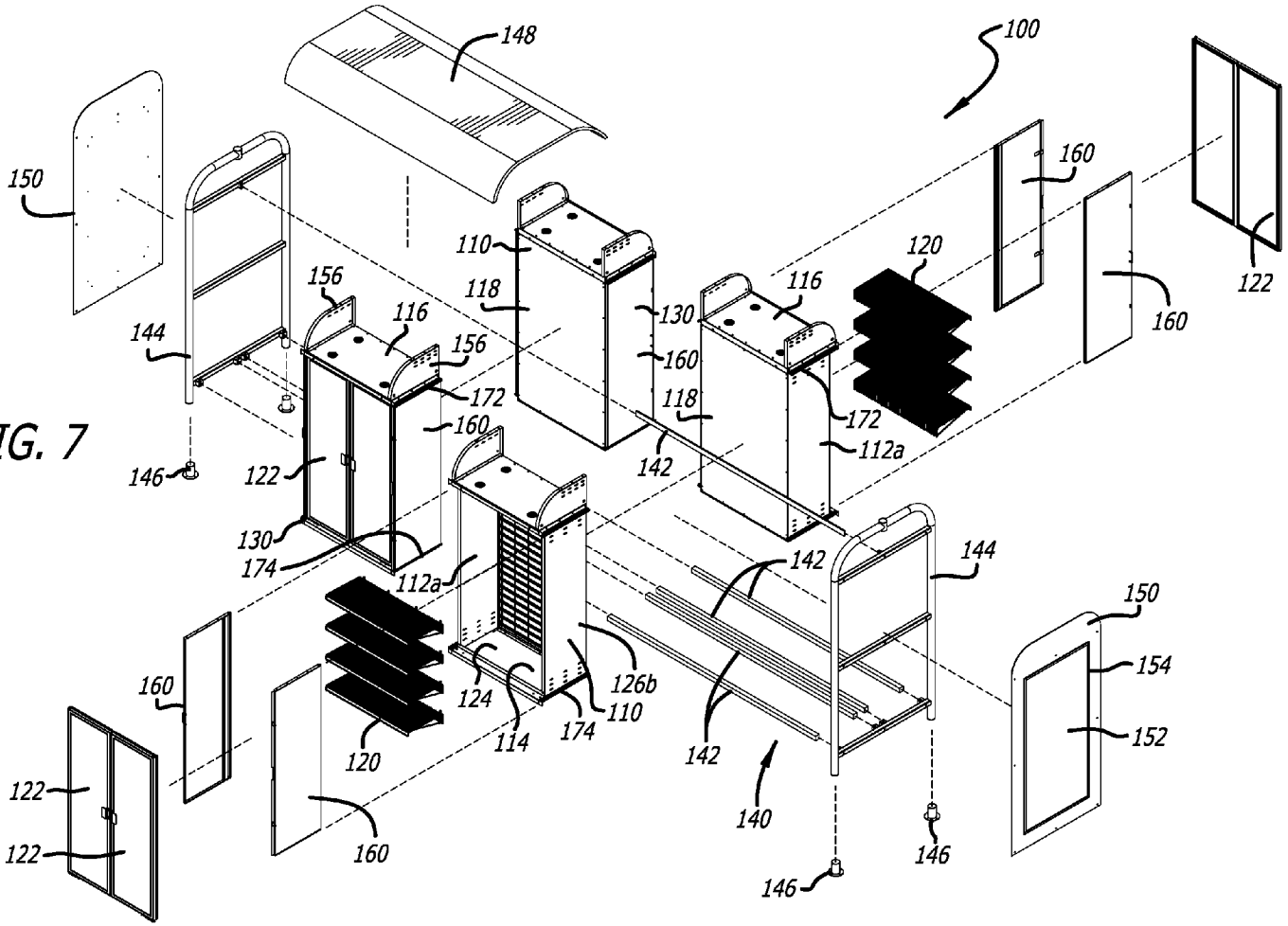
FIG. 7 is an exploded perspective view of the merchandise display system of FIG. 1.
Figure 8:
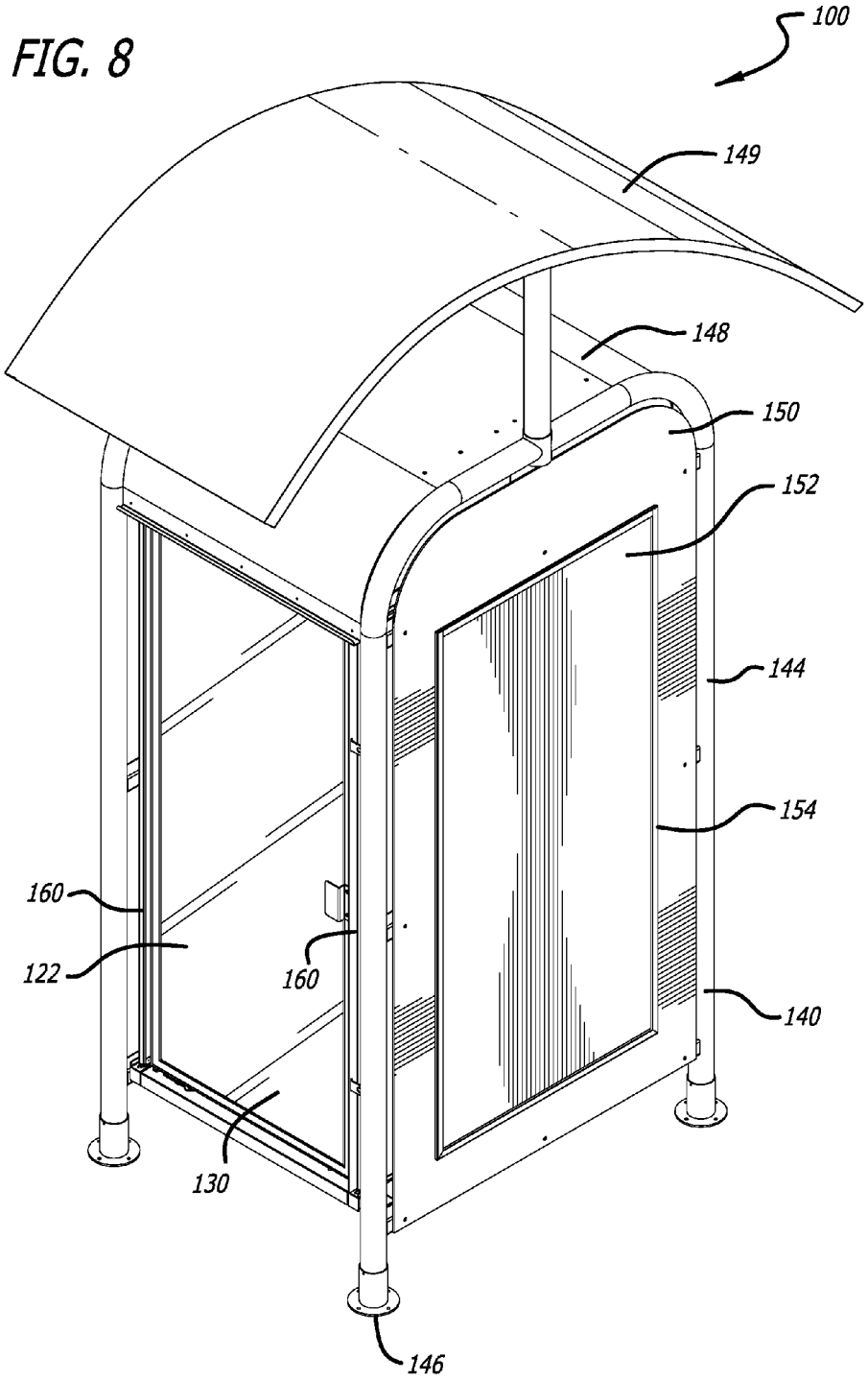
FIG. 8 is a perspective view of another embodiment of a merchandise display system.
Figure 11:
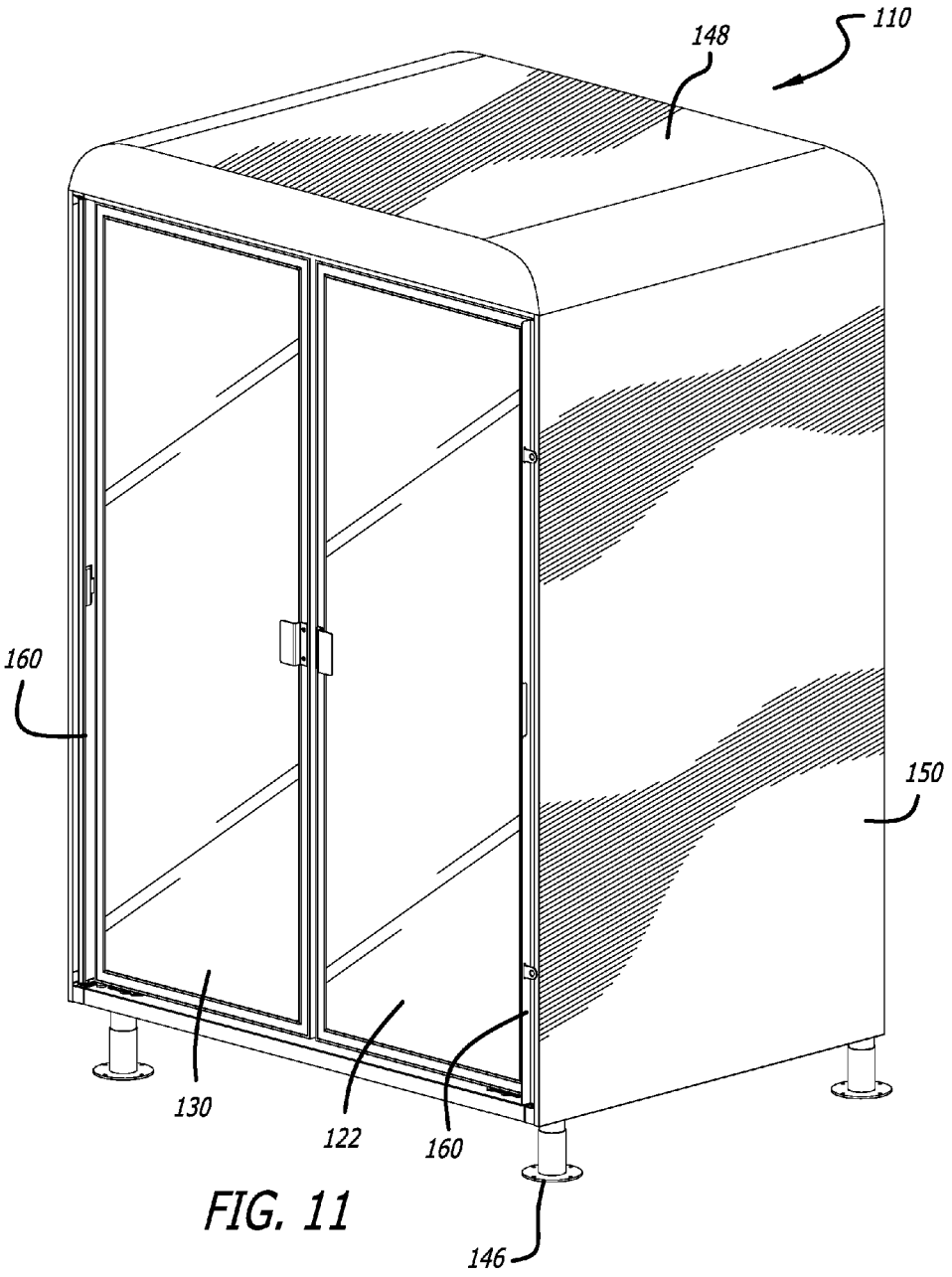
FIG. 11 is a perspective view of another embodiment of a merchandise display system.

The merchandise display system 100 is preferably modular and may include multiple housings 110 or enclosures 130 as best seen in FIGS. 1-4 and 7. In one embodiment there are two pairs of side-by-side enclosures 130 that are provided back-to-back. It is contemplated that any number of enclosures 130 may be used as desired. Each enclosure 130 provides a separate storage and display space. For example, one enclosure 130 may be refrigerated for storing and displaying cold drinks, while another enclosure 130 may be a freezer for storing and displaying frozen goods, and yet another enclosure 130 may be non-refrigerated for storing and displaying non-food items. Further yet, all enclosures 130 may be non-refrigerated and non-freezer type enclosures 130. In the embodiment shown in FIGS. 1-4 and 7, the merchandise display system 100 is configured with enclosures 130 disposed back-to-back to provide access to displayed products on opposite sides of the merchandise display system 100. Any suitable combination of enclosures 130, including a single enclosure 130 as shown in FIG. 11 or two enclosures 130 in a back-to-back-configuration as shown in FIG. 8, are contemplated. Additionally, different types of display doors 122 may be provided with the enclosures 130. For example, FIG. 8 illustrates a modular merchandise display system 100 having two enclosures 130 back-to-back with each side having a single clear display door 122. Because the merchandise display system 100 is modular it will allow for any number and type of enclosure 130.

Figure 9:
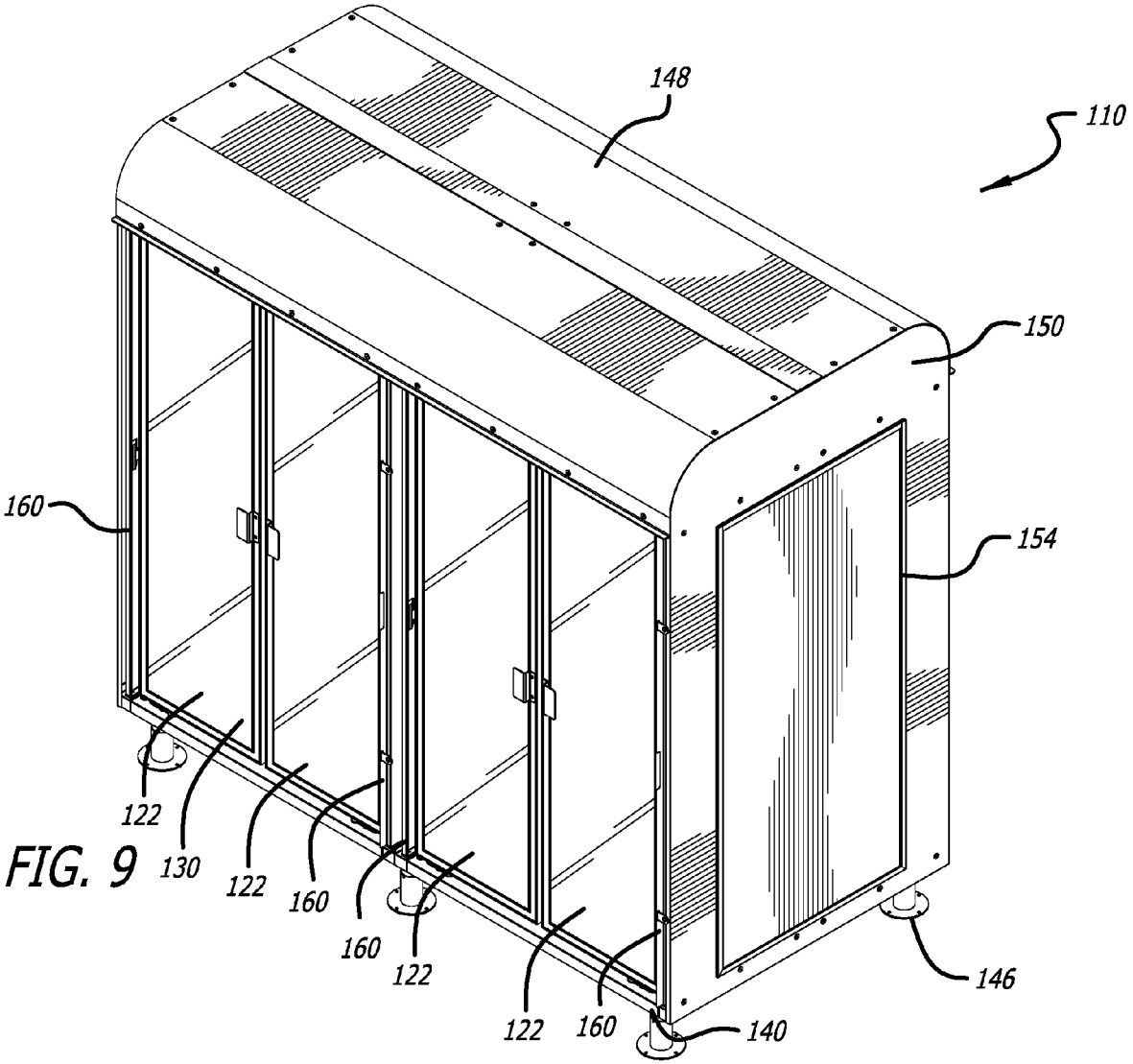
FIG. 9 is a perspective view of another embodiment of a merchandise display system, with the security doors in the open or storage position.
Figure 10:
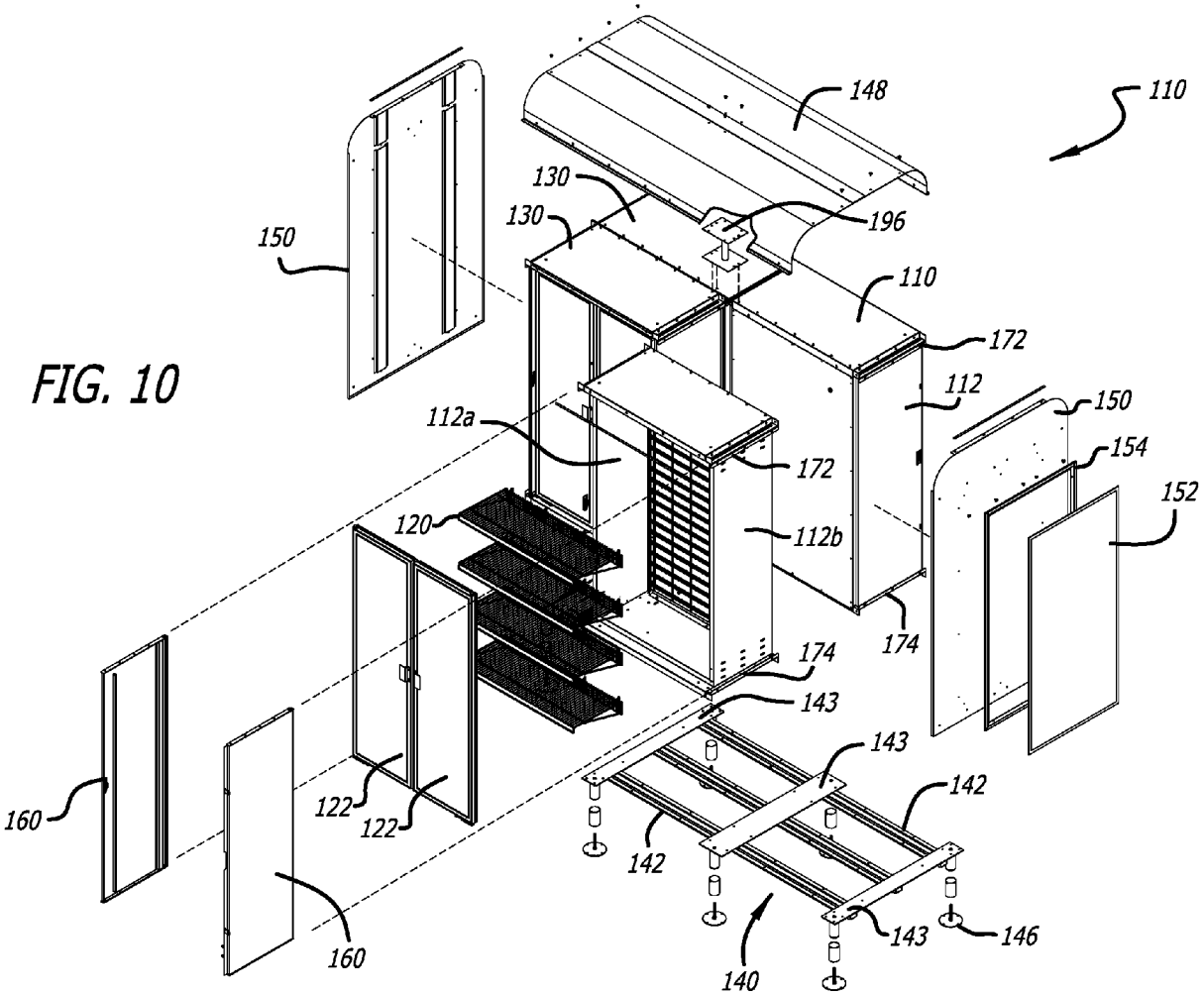
FIG. 10 is an exploded perspective view of the merchandise display system of FIG. 9.

Preferably, frame 140, such as a modular support frame 140, provides support for the enclosures 130. In one embodiment, as shown in FIGS. 1-4, 7 and 8, the modular support frame 140 includes lateral support members 142 connected to side frames 144. As explained herein, alternate support frames 140 are shown in the embodiments of FIGS. 9-11. With reference to FIG. 7, in one embodiment, for example, some lateral support members 142 may be connected to the lower area of the side frames 144 while other lateral support members 142 may be connected to the top area of the side frames 144. The enclosures 130 may be supported by some of the lateral support members 142 to support a variety of number of enclosures 130 about the length of the support members 142. In an alternate embodiment, not shown, there may be three side frames 144, including one on each end and one in the middle, with support members 142 extending in opposing directions from the middle side frame 144 toward the respective outer side frames 144.

In alternate embodiments, support legs 146 or feet 146 may be provided for the side frames 144 to raise the bottom support members 142 above the surface (e.g., ground, asphalt, and cement) upon which the merchandise display system 100 is standing, as shown in the figures.

Additionally, in various embodiments, top panels 148 are provided and may be supported, at least in part, by the side frames 144. The top panels 148 may extend between side frames 144 and conform to the outline of the side frame 144. Thus, multiple side-by-side enclosures 130, and/or back-to-back enclosure 130, may look like a single continuous unit for aesthetic purposes. The tope panels 148 may comprise a single member or they made be made of multiple parts. As shown in FIG. 1, in one embodiment, the side frames 144 form an upside down U-shape and the top panels 148 are correspondingly shaped to match the rounded upper corners of the side frames 144. As shown in FIG. 7, top panel supports 156 may be provided for additional support for the top panel(s) 148. The top panel(s) may be connected and sealed, such as with weather stripping on the top of the top panel supports 156.

In one embodiment, as shown in FIG. 8, a protective overhang 149 may be disposed on the top of the merchandise display system 100. The protective overhang 149 may be connected to any of the top panels 148, the support frame 140 or the modular enclosures 130. The protective overhang 149 may provide some measure of protection from weather elements (e.g., sunlight, rain, snow, hail, etc.) for someone using the merchandise display system 100. For example, the protective overhang 149 may extend out beyond the front and back of the merchandise display system 100. The protective overhang 149 may be configured to be easily added or removed to provide flexibility in configuring the merchandise display system 100. For example, no protective overhang 149 is needed if the merchandise display system 100 is to be located in a protected area (e.g., inside a building or underneath a gas station overhang).

In various embodiments, as shown in FIGS. 1-4, 7 and 8, side panels 150 may be connected to the side frames 144. And, in different embodiments, the side panels 150 may include a display area 152. For example, each display area 152 may have a promotional or advertising sign. Alternately, the side panels 150 may include a support 154 for retaining the display 152, such as a side graphic panel 152.

Figure 2:
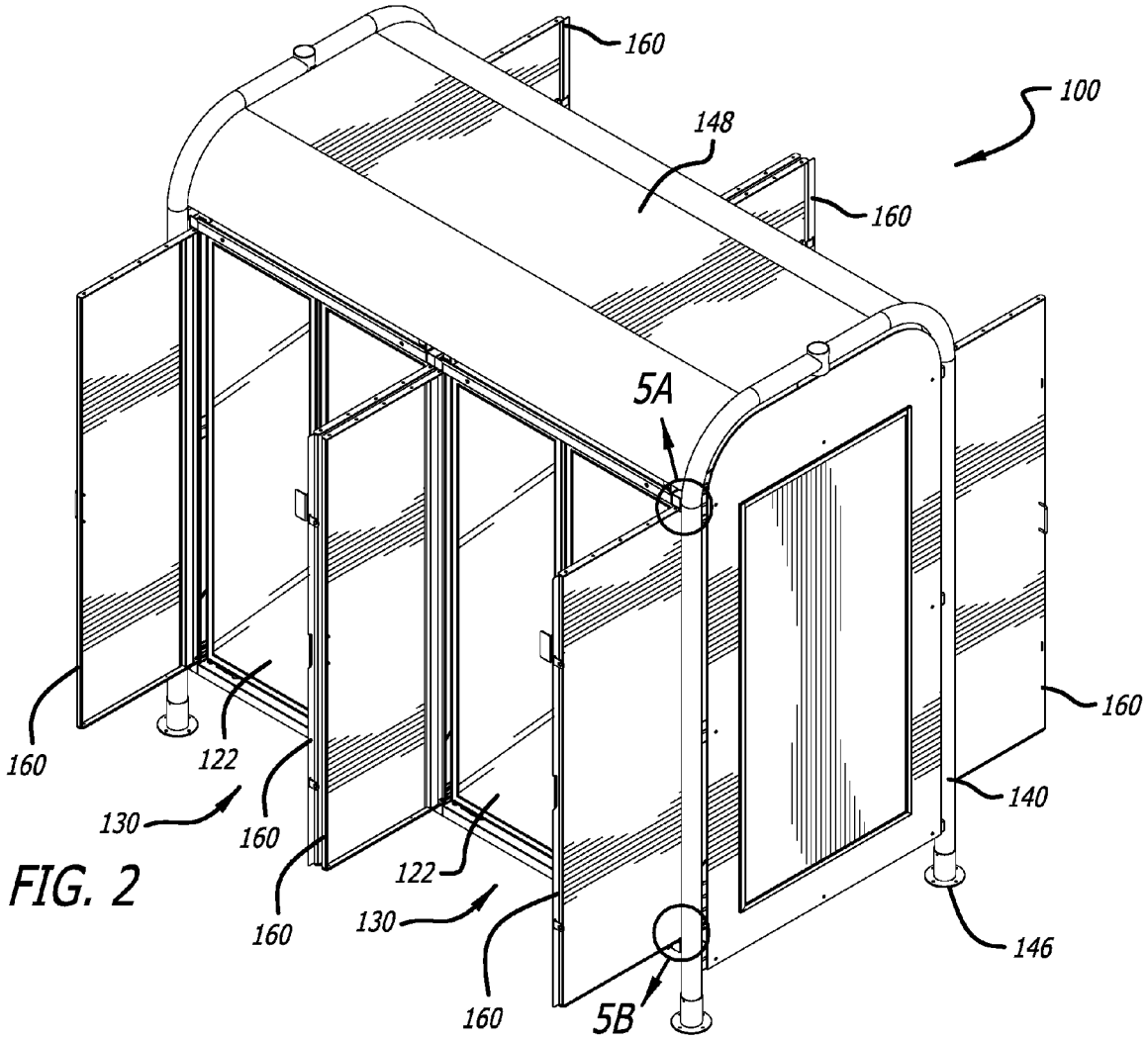
FIG. 2 is a perspective view of the merchandise display system of FIG. 1, with the security doors pulled out prior to closing the doors and securing the merchandise display system.
Figure 3:
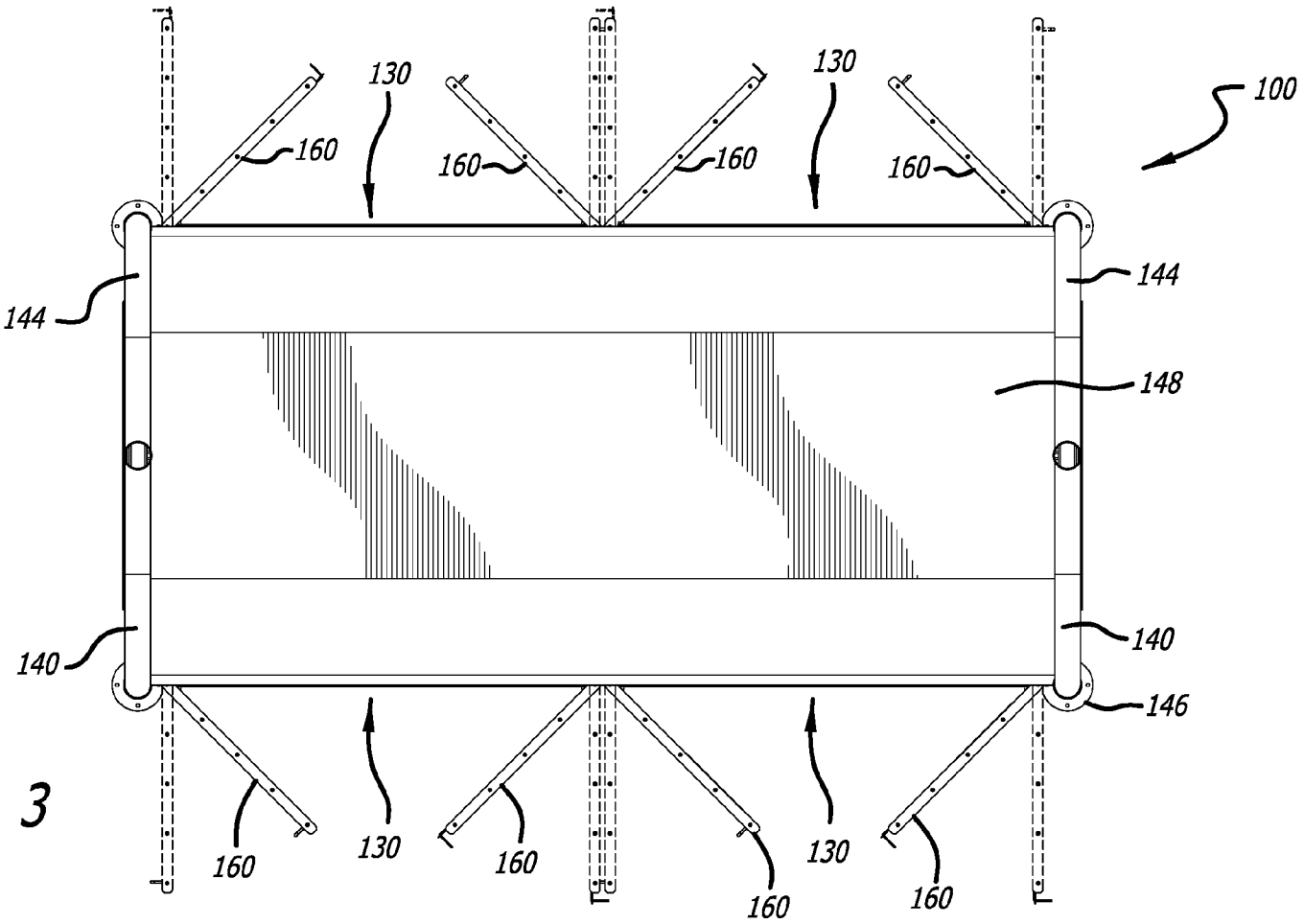
FIG. 3 is a top view of the merchandise display system of FIG. 1, with the security doors shown transitioning from the pulled out position toward the closed position.
Figure 4:
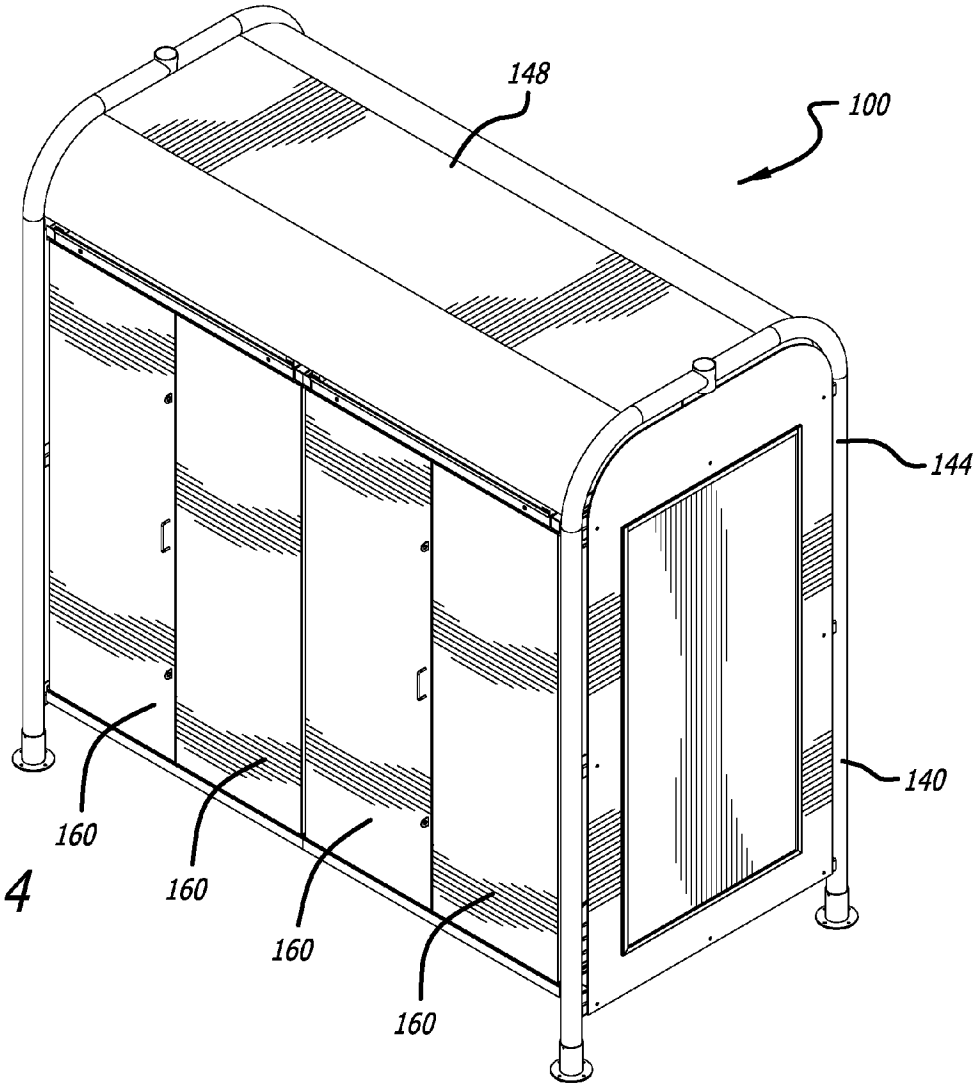
FIG. 4 is a perspective view of the merchandise display system of FIG. 1, with the security doors closed.

The merchandise display system 100 also preferably includes security doors 160. The security doors 160 may be stored in the open position of the security doors 160, as shown in FIG. 1, such as within door pockets 162 disposed adjacent the side walls 112 of the enclosures 130. The security doors 160 may slide into and out of the door pockets 162. For example, the security doors 160 may slide fully into the door pockets 162 for storage to provide full access to the products within the merchandise display system 100 as shown in FIG. 1 (e.g., during business hours of a gas station). In addition to being slidably moveable about the side walls 112 of the enclosures 130, the security door 160 may also be pivotally connected to support brackets 172, 174. The pivoting connection of the security door 160 provides for the security door 160 to pivot into a closed or fully secured position and then locked to an opposing security door 160, thus securing the products within the merchandise display system 100 as shown in FIG. 4 (e.g., when the gas station is closed). As shown in FIG. 2, in one embodiment, the security doors 160 are slidingly pulled out of the door pockets 162 to an intermediate position between the fully stored position and the fully closed/secured position. For example, from the intermediate position shown in FIG. 2 the security doors 160 may be slidingly pushed into the door pockets 162 (as shown in FIG. 1) to provide full access to the display doors 122 during business hours, or the security doors 160 may be pivoted to a closed position (as shown in FIG. 4) where the security doors 160 cover the enclosures 130, after which the security doors 160 may be secured or locked (e.g., padlock, key lock) in place to prevent access to the products within the merchandise display system 100 during hours the establishment is closed. The slidable, pivotable configuration of security doors 160 does not require an overhead storage area, such as that required by an overhead roll down security door. Thus, the merchandise display system 100 may be configured with a lower height than a unit with a roll down security door, allowing the merchandise display system 100 to be placed in locations with a low clearance.

In one embodiment, as shown in FIGS. 5A, 5B, 6 and 7, the door pockets 162 may be formed by an upper bracket 172 and a lower bracket 174. The upper bracket 172 is preferably connected to the sidewall 112 of the enclosure 130 adjacent a top of the enclosure 130. The lower bracket 174 is preferably connected to the sidewall 112 of the enclosure 130 adjacent a bottom of the enclosure 130. The upper brackets 172 and lower brackets 174 preferably have a slot 176 extending about a length of the respective brackets 172, 174. In one embodiment, the upper bracket 172 preferably has an S-shape, including a planar portion 177 in which the slot 176 is provided, and a downwardly extending flange 178, which assists in forming the door pocket 162. Similarly, in one embodiment, the lower bracket 174 preferably has an S-Shape, including a planar portion 180 in which the slot 176 is provided, and an upwardly extending flange 182, which similarly assists in forming the door pocket 162.

Figure 5A:
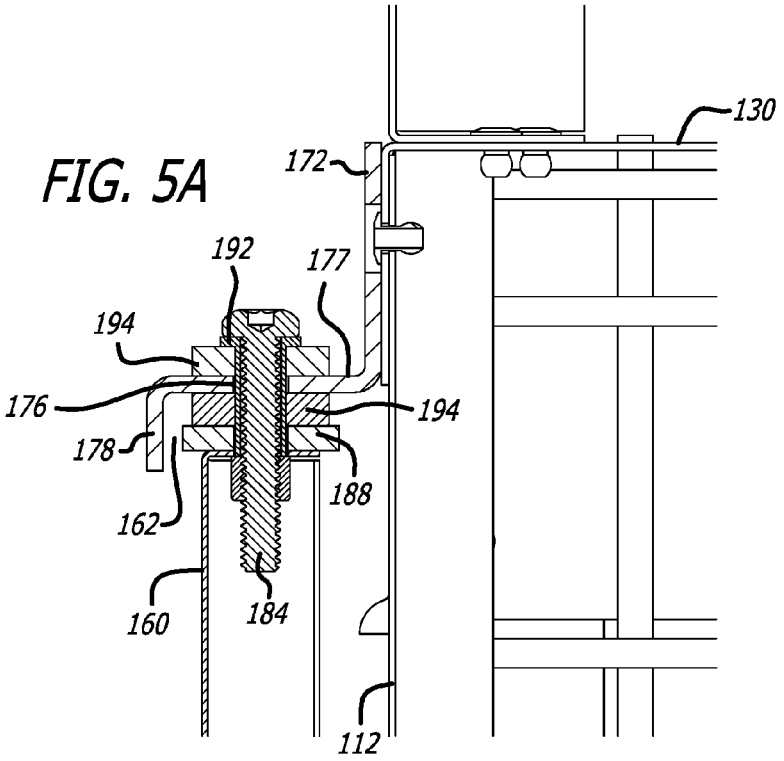
FIG. 5A is an enlarged view of a portion of an upper pivot/slide mechanism of the merchandise display system of FIG. 2.
Figure 5B:
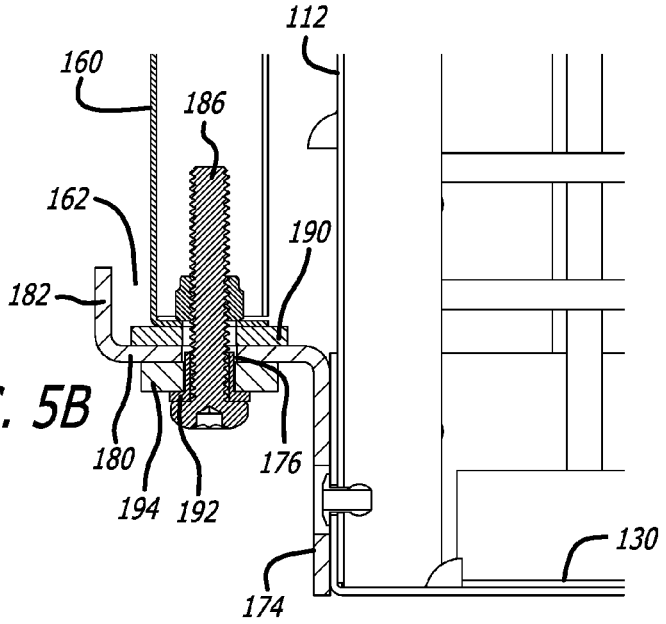
FIG. 5B is an enlarged view of a portion of a lower pivot/slide mechanism of the merchandise display system of FIG. 2.
Figure 6:
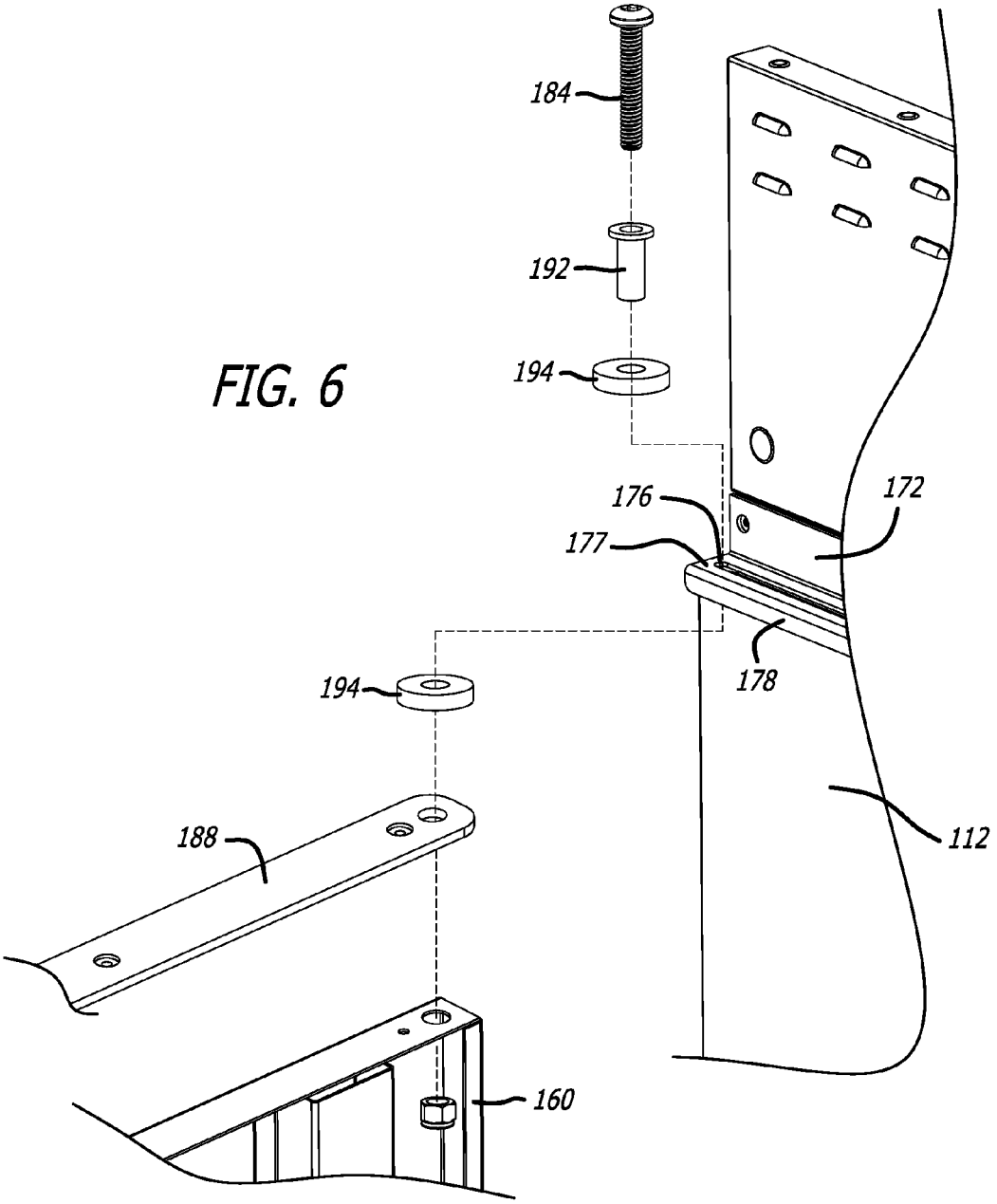
FIG. 6 is an exploded view of the upper pivot/slide mechanism of FIG. 5A.

As shown in FIGS. 5A, 5B and 6, the security doors 160 have a first pin 184 extending from the top of the security doors 160, and a second pin 186 extending from the bottom of the security doors 160. In one embodiment, the pins 184, 186 are bolts that are connected to the doors 160. The first pin 184 extends from the top of the door 160 and through the slot 176 in the planar portion 177 of the upper bracket 172. Conversely, the second pin 186 extends from the bottom of the door 160 and through the slot 176 in the planar portion 180 of the lower bracket 174.

Preferably, a plurality of bushings and sliding surfaces are provided to assist in allowing the security doors 160 to slide and pivot more easily with respect to the upper and lower brackets 172, 174. As shown in FIGS. 5A and 6, in one embodiment, a sliding member 188 is provided on the top surface of the security doors 160 (see FIGS. 5A and 6), and a separate sliding member 190 is provided on the bottom surface of the security doors 160 (see FIG. 5B). In one embodiment the sliding members 188, 190 are made of nylon or Teflon, or the like. In a preferred embodiment, the sliding members 188, 190 have a width greater than a width of the security doors 160. This is best seen in FIGS. 5A and 5B. By having the width of the sliding members 188, 190 greater than a width of the security doors 160 the contact surface of the door assembly with the flanges 180, 182 of the brackets 172, 174, if any, and with the exterior of the sidewalls 112 of the enclosures 130 will be by the sliding member 188, 190 as opposed to the door 160.

Referring to FIGS. 5A, 5B and 6, a shoulder bushing 192 is provided around the first and second pins 184, 186 within the slots 176 of the upper and lower brackets 172, 174 to provide a better sliding engagement between the doors 160 and the upper and lower brackets 172, 174. Further, washer-style bushings 194 may be provided around the shoulder bushing 192 and on one or more sides of the upper and lower brackets 172, 174. For example, as shown in FIGS. 5A and 6, a bushing 194 is provided between the upper bracket 172 and the top of the security door 160 (preferably between the upper bracket 172 and the sliding member 188), and another bushing 194 may be provided between the top of the upper bracket 172 and head of the first pin 184. Referring to FIG. 5B, a bushing 194 is provided between the head of the second pin 186 and the bottom of the lower bracket 174. While not shown, another bushing 194 may be provided tween the sliding member 190 on the bottom of the door 160 and the top surface of the bottom bracket 174.

Another embodiment of the merchandise display system 100 is shown in FIGS. 9 and 10. In this embodiment a plurality of enclosures 130 are provided as part of the merchandise display system 100, however, the merchandise display system 100 may only have one or more enclosures 130. Specifically, in one embodiment, four enclosures 130 are provided in a two by two, side-by-side and back-to-back arrangement, however fewer or more enclosures 130 may be utilized in the merchandise display system 100. The enclosures 130 may be identical to, or substantially the same as, the enclosures described with the prior embodiment of the merchandise display system 100. A majority of the structure of the merchandise display system 100 of this embodiment is the same as the prior embodiment, however, an alternate support frame 140 is provided and no specific side frame 144 is provided. Instead, the side panels 150 assist in performing the function and structure of the side frame 144 of the prior embodiment.

As shown in FIG. 10, the support frame 140 comprises a plurality of lateral support members 142 and a plurality of transverse supports 143 connected to the lateral support members 142. In one embodiment, the enclosures 130 may be supported on the transverse supports 143 and the feet 146 may be connected as well to the transverse supports 143. Since no side frame 144 is provided in this embodiment, the side panels 150 are secured to the enclosures 130 to provide rigidity to the overall structure. In one embodiment, the side panels 150 may be connected to the upper and lower brackets 172, 174 connected to the enclosures 130.

Additionally, as shown in FIG. 10, a connector 196 may be provided to further connect the enclosures 130. The connector 196 may have a first end connected to the top of the enclosures 130 to secure the enclosures 130 together, and a second end that supports the top panel 148.

A further alternate embodiment of a modular display system 100 is shown in FIG. 11. In this embodiment, a single enclosure 130 is provided. The security doors 160 in this embodiment are shown in the open position.

The modular configuration of the merchandise display system 100 provides for improvements in manufacturing and assembly. For example, in one embodiment a single sized and shaped side frame 144 may be used for any configuration, where the width of the support frame 140 is determined by the length of the support members 142. Thus, a variety of configuration may be provided using fewer modular and interchangeable components, lowering manufacturing and storing costs while increasing system flexibility.

The method of assembling the merchandise display system 100 is efficient and cost effective. For example, for any desired size and configuration, the assembly may begin by connecting the appropriately sized support members 142 to either side frames 144 or transverse supports 143, as appropriate to provide an appropriately sized support frame 140. The corresponding number of enclosures 130 may then be connected to and secured within the support frame 140. A corresponding number of security doors 160 may be connected to the enclosures 130. Side panels 150 are attached to each end, and then a properly sized top panel 148 is attached. If desired, a protective overhang 149 may be connected to the top panels 148 and/or the support frame 140. The desired number of shelves 120 may be arranged within each enclosure 130.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the disclosed embodiments may be embodied in other specific forms without departing from the spirit or central characteristics thereof. The present examples and embodiments, therefore, are to be considered in all respects as illustrative and not restrictive, and the disclosed embodiments are not to be limited to the details given herein. Accordingly, while the specific embodiments have been illustrated and described, numerous modifications come to mind without significantly departing from the spirit of the disclosure and the scope of protection is only limited by the scope of the accompanying Claims.

What is claimed is:

1. A modular merchandise display system comprising:

a first enclosure having a top wall, a bottom wall, a back wall connecting the top wall and the bottom wall, a first side wall connecting the top wall, bottom wall and back wall, and a second side wall connecting the top wall, bottom wall and back wall, the first enclosure having a first interior cavity between the first side wall, top wall, bottom wall, second side wall and back wall, the first enclosure further having at least one door at a front of the first enclosure closing the first interior cavity;

a frame supporting the first enclosure;

a first upper bracket connected to the first side wall of the first enclosure adjacent a top of the first enclosure, the first upper bracket having a slot extending about a length of the first upper bracket;

a first lower bracket connected to the first side wall of the first enclosure adjacent a bottom of the first enclosure, the first lower bracket having a slot extending about a length of the first lower bracket;

a first security door for the first enclosure, the first security door being adjacent the first side wall of the first enclosure in an open position, the first security door having a first pin extending from a top thereof and through the slot in the first upper bracket, the first security door further having a second pin extending from a bottom thereof and through the slot in the first lower bracket, wherein the first upper bracket and first lower bracket have flanges to form a pocket for the first security door, the first security door being slidingly moveable to be positioned exterior of the first enclosure, the first security door further being pivotable about the first upper and lower brackets to be positioned substantially parallel to the front of the first enclosure in a closed position;

a second upper bracket connected to the second side wall of the first enclosure adjacent a top of the first enclosure, the second upper bracket having a slot extending about a length of the second upper bracket;

a second lower bracket connected to the second side wall of the first enclosure adjacent a bottom of the first enclosure, the second lower bracket having a slot extending about a length of the second lower upper bracket, a second security door for the first enclosure, the second security door being adjacent the second side wall of the first enclosure in an open position, the second security door having a first pin extending from a top thereof and through the slot in the second upper bracket, the second security door further having a second pin extending from a bottom thereof and through the slot in the second lower bracket, wherein the second upper bracket and second lower bracket have flanges to form a pocket for the second security door, the second security door being slidingly moveable to be positioned exterior of the second enclosure, the second security door further being pivotable about the second upper and lower brackets to be positioned substantially parallel to the front of the second enclosure in a closed position, wherein the first security door is adapted to be secured to the second security door when the first and second security doors are in the closed positions;

a first side panel connected adjacent the first side wall of the first enclosure, and a second side panel connected adjacent the second side wall of the first enclosure; and, a top panel over the first enclosure.

2. The modular merchandise display system of claim 1, wherein the first side panel is connected to the first upper bracket and first lower bracket, and wherein the second side panel is connected to the second upper bracket and second lower bracket.

3. The modular merchandise display system of claim 1, further comprising separate sliding members connected, respectively, to the bottom of the first security door and second security door.

4. The modular merchandise display system of claim 3, wherein the sliding members have a width greater than a width of the respective first security door and second security door to assist in sliding the first security door and second security door from the open position to the closed position.

5. The modular merchandise display system of claim 1, further comprising a bushing between the first upper bracket and a top of the first security door, and a bushing between the second upper bracket and a top of the second security door.

6. A modular merchandise display system comprising:

a first enclosure having a top wall, a bottom wall, a back wall connecting the top wall and the bottom wall, a first side wall connecting the top wall, bottom wall and back wall, and a second side wall connecting the top wall, bottom wall and back wall, the first enclosure having a first interior cavity between the first side wall, top wall, bottom wall, second side wall and back wall, the first enclosure further having at least one door at a front of the first enclosure closing the first interior cavity;

a second enclosure having a top wall, a bottom wall, a back wall connecting the top wall and the bottom wall, a first side wall connecting the top wall, bottom wall and back wall, and a second side wall connecting the top wall, bottom wall and back wall, the second enclosure having a second interior cavity between the first side wall, top wall, bottom wall, second side wall and back wall, the second enclosure further having at least one door at a front of the second enclosure closing the second interior cavity;

a frame supporting the first enclosure and the second enclosure, the frame having lateral supports and feet;

a first upper bracket connected to the first side wall of the first enclosure adjacent a top of the first enclosure, the first upper bracket having a slot extending about a length of the first upper bracket;

a first lower bracket connected to the first side wall of the first enclosure adjacent a bottom of the first enclosure, the first lower bracket having a slot extending about a length of the first lower bracket;

a first security door for the first enclosure, the first security door being adjacent the first side wall of the first enclosure in an open position, the first security door having a first pin extending from a top thereof and through the slot in the first upper bracket, the first security door further having a second pin extending from a bottom thereof and through the slot in the first lower bracket, the first security door being slidingly moveable about the first side wall of the first enclosure to be positioned exterior of the first enclosure, the first security door further being pivotable about the first upper and lower brackets to be positioned substantially parallel to the front of the first enclosure in a closed position;

a second upper bracket connected to the second side wall of the first enclosure adjacent a top of the first enclosure, the second upper bracket having a slot extending about a length of the second upper bracket;

a second lower bracket connected to the second side wall of the first enclosure adjacent a bottom of the first enclosure, the second lower bracket having a slot extending about a length of the second lower bracket;

a second security door for the first enclosure, the second security door being adjacent the second side wall of the first enclosure in an open position, the second security door having a first pin extending from a top thereof and through the slot in the second upper bracket, the second security door further having a second pin extending from a bottom thereof and through the slot in the second lower bracket, the second security door being slidingly moveable about the second side wall of the first enclosure to be positioned exterior of the first enclosure, the second security door further being pivotable about the second upper and lower brackets to be positioned substantially parallel to the front of the first enclosure in a closed position, and wherein the first security door is adapted to be secured to the second security door in the closed position;

a third upper bracket connected to the first side wall of the second enclosure adjacent a top of the second enclosure, the third upper bracket having a slot extending about a length of the third upper bracket;

a third lower bracket connected to the first side wall of the second enclosure adjacent a bottom of the second enclosure, the third lower bracket having a slot extending about a length of the third lower bracket;

a third security door for the second enclosure, the third security door being adjacent the first side wall of the second enclosure in an open position, the third security door having a first pin extending from a top thereof and through the slot in the third upper bracket, the third security door further having a second pin extending from a bottom thereof and through the slot in the third lower bracket, the third security door being slidingly moveable about the first side wall of the second enclosure to be positioned exterior of the second enclosure, the third security door further being pivotable about the third upper and lower brackets to be positioned substantially parallel to the front of the second enclosure in a closed position;

a fourth upper bracket connected to the second side wall of the second enclosure adjacent a top of the second enclosure, the fourth upper bracket having a slot extending about a length of the fourth upper bracket;

a fourth lower bracket connected to the second side wall of the second enclosure adjacent a bottom of the second enclosure, the fourth lower bracket having a slot extending about a length of the fourth lower bracket;

a fourth security door for the second enclosure, the fourth security door being adjacent the second side wall of the second enclosure in an open position, the fourth security door having a first pin extending from a top thereof and through the slot in the fourth upper bracket, the fourth security door further having a second pin extending from a bottom thereof and through the slot in the fourth lower bracket, the fourth security door being slidingly moveable about the second side wall of the second enclosure to be positioned exterior of the second enclosure, the fourth security door further being pivotable about the fourth upper and lower brackets to be positioned substantially parallel to the front of the second enclosure in a closed position, and wherein the fourth security door is adapted to be secured to the third security door in the closed position; and, a top panel over the first and second enclosure.

7. The modular merchandise display system of claim 6, wherein the first upper bracket and first lower bracket have flanges to form a pocket for the first security door, wherein the second upper bracket and second lower bracket have flanges to form a pocket for the second security door, wherein the third upper bracket and third lower bracket have flanges to form a pocket for the third security door, and wherein the fourth upper bracket and fourth lower bracket have flanges to form a pocket for the fourth security door.

8. The modular merchandise display system of claim 6, further comprising separate sliding members connected, respectively, to the bottom of the first security door, second security door, third security door and fourth security doors.

9. The modular merchandise display system of claim 8, wherein the sliding members have a width greater than a width of the respective first security door, second security door, third security door and fourth security doors, to assist in sliding the first security door, second security door, third security door and fourth security doors from the open position to the closed position.

10. The modular merchandise display system of claim 8, further comprising separate sliding members connected, respectively, to the top of the first security door, second security door, third security door and fourth security doors.

11. The modular merchandise display system of claim 10, wherein the sliding members at the top of the security doors have a width greater than a width of the respective first security door, second security door, third security door and fourth security doors, to assist in sliding the first security door, second security door, third security door and fourth security doors from the open position to the closed position.

12. The modular merchandise display system of claim 6, further comprising a bushing between the first upper bracket and a top of the first security door, a bushing between the second upper bracket and a top of the second security door, a bushing between the third upper bracket and a top of the third security door, and a bushing between the fourth upper bracket and a top of the fourth security door.

13. The modular merchandise display system of claim 12, further comprising separate bushings around the first pins extending from the top of the first security door, second security door, third security door and fourth security door.

14. The modular merchandise display system of claim 6, wherein the frame comprises a transverse supports connected to the lateral supports, wherein the enclosures are supported on the transverse supports, and wherein the feet are connected to the transverse supports.

15. The modular merchandise display system of claim 6, further comprising a connector connected to the top of the first and second enclosures to secure the first and second enclosures together, the connector further supporting the top panel.

16. The modular merchandise display system of claim 6, further comprising a first side panel connected to the first side wall of the first enclosure, and a second side panel connected to the second side wall of the second enclosure.

17. The modular merchandise display system of claim 16, further comprising a support on the first and second side panels, respectively, for retaining a side graphic panel.

18. A modular merchandise display system comprising:

a plurality of enclosures, each of the plurality of enclosures having a top wall, a bottom wall, a back wall connecting the top wall and the bottom wall, a first side wall connecting the top wall, bottom wall and back wall, and a second side wall connecting the top wall, bottom wall and back wall, each of the plurality of enclosures having a first interior cavity between the first side wall, top wall, bottom wall, second side wall and back wall thereof, and each of the plurality of enclosures having a door at a front of the enclosure closing the interior cavity;

a frame supporting the plurality of enclosures, the frame having lateral supports and transverse supports, and feet connected to the transverse supports;

each of the plurality of enclosures having a first upper bracket connected to the first side wall of the respective enclosure adjacent a top of the enclosure, the first upper bracket having a slot extending about a length of the first upper bracket;

each of the plurality of enclosures having a first lower bracket connected to the first side wall of the respective enclosure adjacent a bottom of the enclosure, the first lower bracket having a slot extending about a length of the first lower bracket;

each of the plurality of enclosures having a first security door adjacent the first side wall of the respective enclosure in an open position, the first security door having a first pin extending from a top thereof and through the slot in the first upper bracket, the first security door further having a second pin extending from a bottom thereof and through the slot in the first lower bracket, wherein the first upper bracket and first lower bracket have flanges to form a pocket for the first security door, the first security door being slidingly moveable to be positioned exterior of the respective enclosure, the first security door further being pivotable about the first upper and lower brackets to be positioned substantially parallel to the front of the respective enclosure in a closed position;

each of the plurality of enclosures having a second upper bracket connected to the second side wall of the respective enclosure adjacent a top of the enclosure, the second upper bracket having a slot extending about a length of the second upper bracket;

each of the plurality of enclosures having a second lower bracket connected to the second side wall of the respective enclosure adjacent a bottom of the enclosure, the second lower bracket having a slot extending about a length of the second lower bracket;

each of the plurality of enclosures having a second security door adjacent the second side wall of the respective enclosure in an open position, the second security door having a first pin extending from a top thereof and through the slot in the second upper bracket, the second security door further having a second pin extending from a bottom thereof and through the slot in the second lower bracket, wherein the second upper bracket and second lower bracket have flanges to form a pocket for the second security door, the second security door being slidingly moveable to be positioned exterior of the respective enclosure, the second security door further being pivotable about the second upper and lower brackets to be positioned substantially parallel to the front of the respective enclosure in a closed position, wherein each first security door is adapted to be secured to the respective second security door when the first and second security doors are in the closed positions;

a first side panel connected adjacent the first side wall of one enclosure and the second side wall of an adjacent enclosure, and a second side panel connected adjacent the second side wall of another enclosure and the first sidewall of an adjacent enclosure;

a top panel over the plurality of enclosures; and, a connector having one end connecting the top of the plurality of enclosures, and a second end supporting the top panel.

19. The modular merchandise display system of claim 18, further comprising separate sliding members connected, respectively, to the bottom of the first and second security doors.

20. The modular merchandise display system of claim 18, further comprising a support on the first and second side panels, respectively, for retaining a side graphic panel.

* * * * *